United States Patent [19]

Gambetti

[11] Patent Number: 4,716,707

[45] Date of Patent: Jan. 5, 1988

[54] APPARATUS FOR SHRINK-WRAPPING ARTICLES WITH HANDLES

[75] Inventor: Mario Gambetti, Crevalcore, Italy

[73] Assignee: "Baumer di Mario Gambetti", Castelfranco Emilia, Italy

[21] Appl. No.: 881,009

[22] Filed: Jul. 1, 1986

[30] Foreign Application Priority Data

Jul. 10, 1985 [IT] Italy ..... 3497 A/85

[51] Int. Cl.[4] ..... B65B 6/14

[52] U.S. Cl. ..... 53/134; 53/220; 53/557

[58] Field of Search ..... 53/134, 137, 139.3, 53/580, 582, 557, 210, 228, 220, 389; 493/210, 347, 221, 382, 223, 383, 315, 388

[56] References Cited

U.S. PATENT DOCUMENTS

| | | | |
|---|---|---|---|
| 2,689,506 | 9/1954 | Bagnall | 493/221 |
| 2,717,710 | 9/1955 | Baker et al. | 493/347 X |
| 2,775,171 | 12/1956 | Steen et al. | 493/221 X |
| 3,101,033 | 8/1963 | Bonsor | 493/221 |
| 3,481,256 | 12/1969 | Hayes | 493/221 |
| 3,835,756 | 9/1974 | Bosse | 493/221 |
| 4,574,565 | 3/1986 | Gambetti . | |
| 4,605,459 | 8/1986 | Voltmer et al. | 53/137 X |

FOREIGN PATENT DOCUMENTS

| | | | |
|---|---|---|---|
| 0174015 | 3/1986 | European Pat. Off. . | |
| 0178142 | 4/1986 | European Pat. Off. . | |
| 1049767 | 1/1959 | Fed. Rep. of Germany | 53/134 |
| 1279036 | 6/1972 | United Kingdom . | |
| 1383108 | 2/1975 | United Kingdom . | |

*Primary Examiner*—Robert L. Spruill
*Assistant Examiner*—Steven P. Weihrouch
*Attorney, Agent, or Firm*—Karl F. Ross; Herbert Dubno

[57] ABSTRACT

An apparatus for the application of strips of material to a heat-shrinkable web of wrapping in packaging machines with a tunnel furnace for the formation of the handle of the wrapped products. The apparatus has a wheel assembly supported to rotate about a horizontal axis with the wheel substantially tangential to a substantially horizontal section of the heat-shrinkable material strip, a feeder for the supply of a tape of adhesive material to the periphery of the wheel with the adhesive surface facing outwardly, a container for the supply, in spaced succession, of strips of material to the adhesive surface of the tape of adhesive material, a cutter for cutting the adhesive tape between two successive strips along the path of the wheel and a pressure roller which may be radially displaced with respect to the wheel to apply, by adhesion, the adhesive end areas of the sections of adhesive tape having a corresponding strip applied to them to the strip of heat-shrinkable material.

7 Claims, 7 Drawing Figures

35
34
10
23
11d
11
12
25
25a
24
22
26
21
11c
30
32
28
31
31
11a
33
29
26a
11d
11b
27
15
19
17
15
38
37

APPARATUS FOR SHRINK-WRAPPING ARTICLES WITH HANDLES

FIELD OF THE INVENTION

The present invention relates to an apparatus for the application of strips of material to a wrapping web in packaging machines for the formation of the handle for wrapped articles.

BACKGROUND OF THE INVENTION

In the packaging field, it is known to use a web of heat-shrinkable material to wrap monobloc articles, predominantly of prismatic shape, or more frequently groups of individual articles formed, for example, by containers for products, more particularly food products and the like, having a monolithic prismatic shape referred to hereafter for simplicity as articles, by means of automatic machines which operate discontinuously or continuously and constructed such that they may wrap the heat-shrinkable material about the individual articles to be wrapped in a variety of ways.

It is conventional in this packaging technique to wrap the article to be wrapped with the web of heat-shrinkable material in the direction of the movement of the article such that the material projects beyond two transversely opposite faces of the article and then to pass this wrapped article through a tunnel furnace to cause the material to adhere by heat-shrinkage to the wrapped faces and to the two transversely opposite faces of the article by folding the corresponding material over these latter two faces.

The apparatus of the invention may be advantageously used in automatic machines for the above-mentioned use which operate discontinuously or continuously and particularly in the type of continuously operating machine disclosed in the Italian Patent Application No. 3349 A/83 (see U.S. Pat. No. 4,574,565 issued Mar. 11, 1986).

A machine of this type for wrapping articles supplied in a uniformly spaced manner by means of a continuously moving conveyor with sheets cut in succession from a strip of heat-shrinkable material of a width such as to project beyond two transversely opposite side faces of the article and brought in succession by suction take-up means along their respective longitudinal edges across the feed path between successive articles so as to be folded over the front, top and rear surfaces of a corresponding article in the shape of an upturned U with the end portions of this U extending beyond the respective lower face is substantially provided with the conveyor formed by two adjacent conveyor belt sections and with the take-up means supported between the two adjacent belt sections. The adjacent zones of the two belts are wound on at least a corresponding pair of return rollers supported by a carriage which may be moved in an alternating manner parallel to the conveyor direction and the take-up means are disposed such that they may be moved in an alternating manner vertically and parallel with respect to the movement of the carriage.

SUMMARY OF THE INVENTION

The present invention provides an apparatus for the application of strips of material to a heat-shrinkable wrapping strip in packaging machines for the formation of the handle for the packaged products, these machines wrapping the article to be packaged in the direction of its movement with the heat-shrinkable strip material projecting from two transversely opposite faces of the article and causing the article wrapped in this way to pass into a tunnel furnace to cause the material to adhere by heat-shrinkage to the wrapped faces and to the two transversely opposite faces of the article by folding of the corresponding material over these latter two faces.

According to the invention, the apparatus comprises, above the strip of heat-shrinkable wrapping material being supplied, a wheel assembly supported to rotate about a horizontal axis with the wheel substantially tangential to a substantially horizontal portion of the strip of heat-shrinkable material, this wheel having on its periphery first and second take-up means, means for providing the wheel with a continuous movement, means for actuating the first and second take-up means intermittently in cyclical phase, means for supplying an adhesive strip with its non-adhesive face in peripheral contact with the wheel in conjunction with the first take-up means, means for supplying in spaced sequence strips of material to the adhesive face of this strip of adhesive material, these latter means being formed by a container for the said strips supported in an oscillating manner in a tangential relationship with the wheel, means for actuating this oscillating container, cutting means along the path of the wheel designed to cut the adhesive strip at a median point between two adjacent successive strips, pressure means arranged tangentially with respect to the wheel downstream of the cutting means and radially movable with respect to the wheel for the application, by adhesion, of the end zones of the adhesive portions of adhesive tape with a corresponding strip applied thereto to the strip of heat-shrinkable material and means for actuating the radially movable pressure means.

BRIEF DESCRIPTION OF THE DRAWING

Further features and advantages of the invention will be disclosed in the following detailed description of a preferred embodiment given solely by way of example with reference to the attached drawing, in which.

SPECIFIC DESCRIPTION

Figure 1:
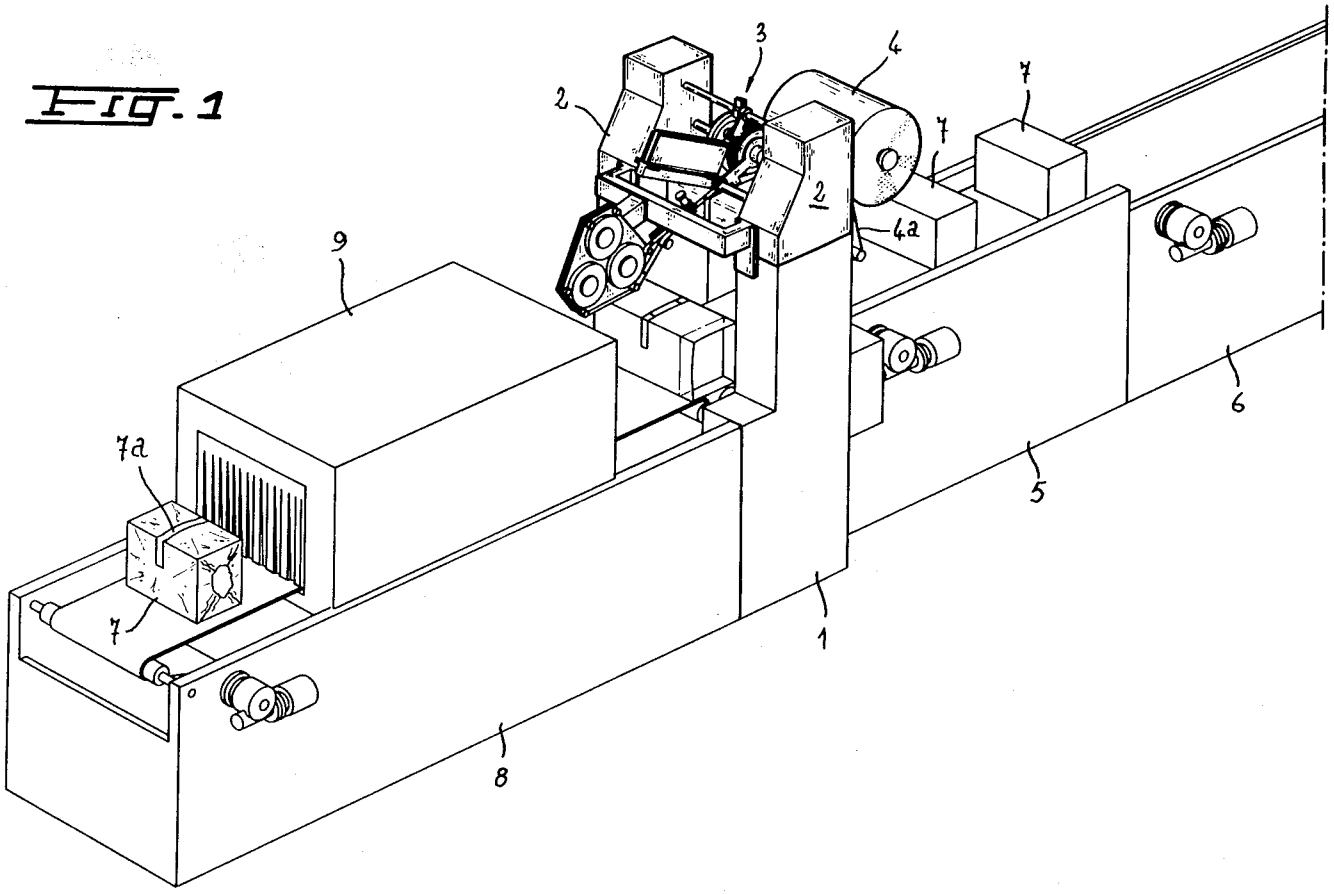
FIG. 1 is a foreshortened front and longitudinal perspective view of the wrapping machine with which the apparatus of the present invention is associated.

The wrapping machine for the wrapping of a continuously moving sequence of articles with sheets or sections cut in succession from a strip of heat-shrinkable material shown by way of example in FIG. 1 and with which the apparatus of the present invention is associated for the application of strips of material to this strip for the formation of the handle for packaged products essentially comprises a base 1 with opposite lateral shoulders 2 which supports the apparatus in question, designated overall by 3, the spool 4 of heat shrinkable strip material 4a and all other components required to wrap the articles with the sheets or sections obtained from this heat-shrinkable strip of the type disclosed, for example, in the above-mentioned patent.

Upstream of this base 1 with opposite shoulders 2 there are provided two machine sections 5 and 6 for the supply of the articles 7 to be wrapped, while downstream there is provided a machine section 8 with a tunnel furnace 9. An article 7 with a handle 7a applied thereto by means of the apparatus 3 of the present invention in the manner to be described below with reference to the description of FIGS. 2 to 7 is shown at the outlet of this tunnel furnace 9.

This apparatus 3 essentially comprises (see FIG. 2) an assembly 10 with a wheel 11 supported to rotate about a horizontal axis by means of a shaft 12 supported on the shoulders 2 of the base 1, an automatic spool change unit 13 of known type having three spools 14 of adhesive tape 15 to be supplied to the periphery of the wheel 11 in the manner described in detail below, with an automatic device 16 for joining the end portion of the tape on one spool to the initial portion of the tape on a further spool, as well as a series of idler return rollers 17 for the adhesive tape 15 being supplied to the wheel 11 and a parallelepipedic container 18 for strips of material 19 supported in a fixed manner on a horizontal shaft 20 supported, in turn, in a rotary manner on the shoulders 2 of the base 1.

Figure 3:
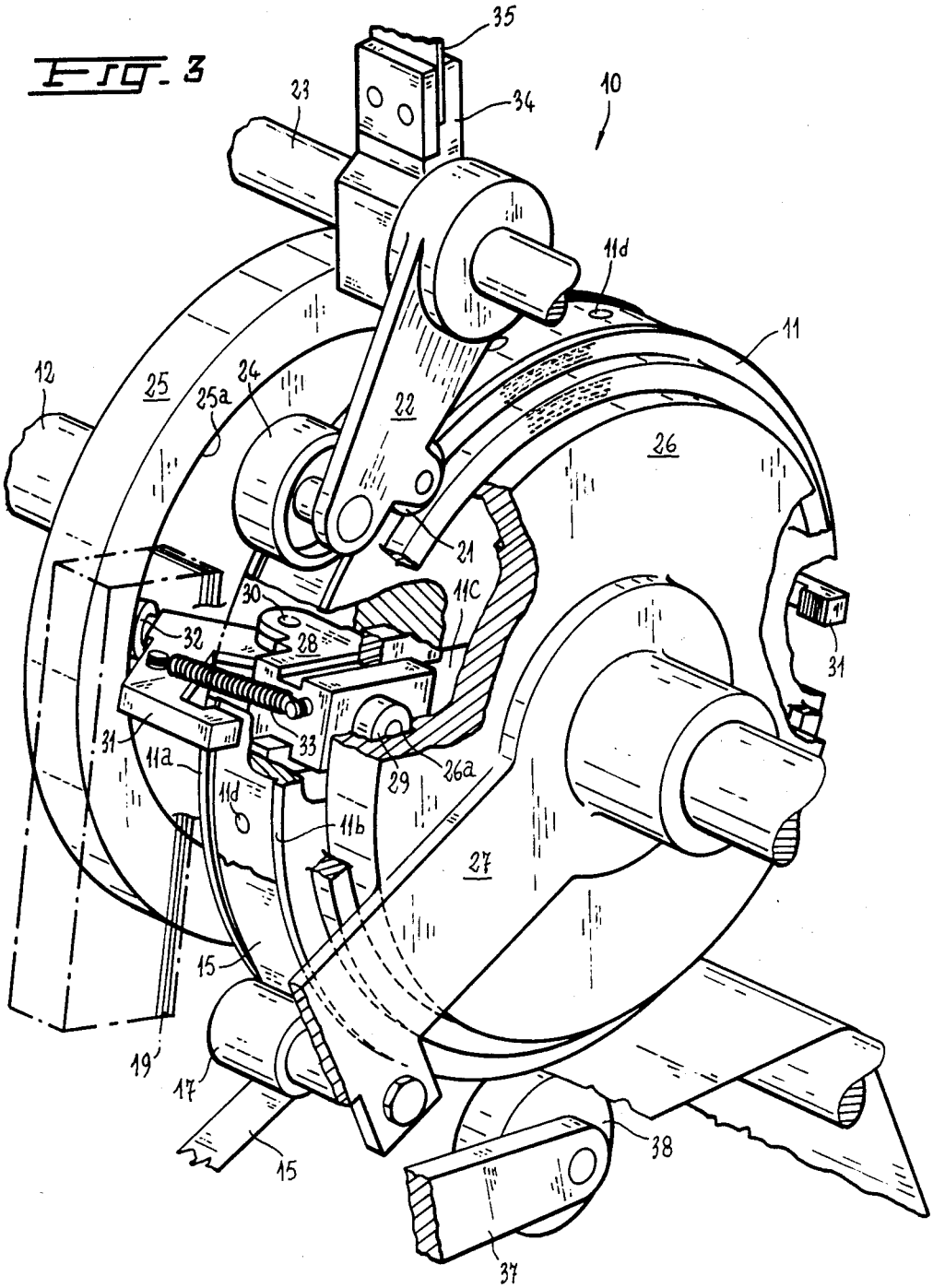
FIG. 3 is a perspective view, on a further enlarged scale, of the fundamental portion of this apparatus with some components in cross-section and others removed to reveal further components more clearly.

The wheel 11 of the device 10 is laterally flanged as shown in FIG. 3 and designated by 11a and 11b.

This latter flange 11 of the assembly 10 has a peripheral cam contour with which there cooperates an idler cam-follower roller 21 supported at an intermediate point of a lever 22 supported to rotate freely at one end by a horizontal shaft 23 also supported to rotate on the shoulders 2 of the base 1 and actuated in the manner described below. At the other end of this oscillating lever 22 there is provided a further idler roller 23 designed to act on the periphery of the wheel 11 and between which the tape of adhesive material 15 with the strips 19 thereon passes in a sequentially spaced manner.

At the sides of the said flanges 11a and 11b of this wheel 11 there are disposed two cam discs 25 and 26 disposed in a stationary manner with respect to the shaft 12 of the wheel 11 and the end of a lever 27 is provided to oscillate on the same shaft 12 externally to the cam disc 26, the other end of the lever having mounted on it one of the idler return rollers 17 arranged tangentially with respect to the wheel 11.

This wheel 11 is provided with a radial cavity 11c (see FIG. 3 in particular) within which there is mounted to slide on a slide a block 28, this block 28 supporting an idler cam-follower roller 29 engaged in the cam throat 26a provided in the internal face of the cam disc 26. A component in the form of a gripper jaw 31 designed to hold the adhesive tape 15 on the periphery of the wheel 11 in the manner to be described in detail below is pivoted at 30 on the slide block 28. This component in the form of a gripper jaw 31 is associated with an idler cam-follower roller 32 operating on a cam track 25a provided on the internal face of the cam disc 25 under the action of a return spring 33 whose opposite ends lead to the component in the form of a gripper jaw 31 and the slide block 28.

In practice, several groups formed by a slide block 28 and the corresponding component in the form of a gripper jaw 31 may be provided. In the example illustrated two of these groups are provided diametrically opposite to one another as shown in FIGS. 4 to 7.

Figure 2:
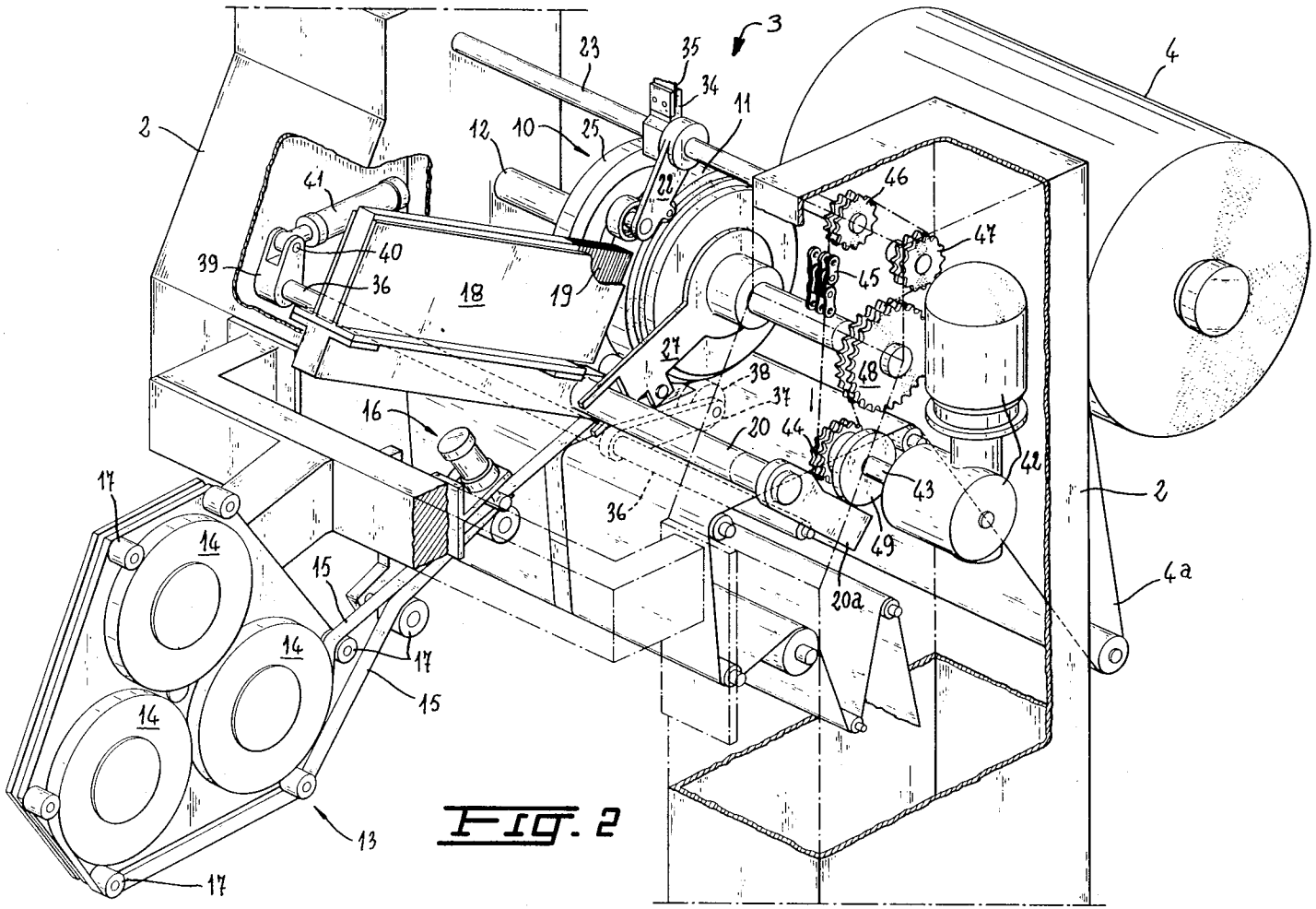
FIG. 2 shows a perspective view, on an enlarged scale, of this apparatus, with some components in cross-section and others removed to reveal further components more clearly.

An element 34 supporting a cutting blade or knife 35 is keyed on the shaft 23, while on the right-hand side, looking at FIG. 2, of the shaft 20 an arm 20a is keyed and the free end of the lever 27 is shaped as a fork, the shaft 20 being mounted between the prongs of this fork (see FIG. 2).

A further shaft 36 again supported by the shoulders 2 of the base 1 in an idle manner is provided in parallel and below the shaft 20. The end of an arm 37 on whose other end there is provided an idler roller 38 designed to operate on the periphery of the wheel 11 is rigid with the shaft 36 at an intermediate point thereof. At the left-hand end, looking at FIG. 2, of the shaft 36 there is provided a further arm 39 whose free end is shaped as a fork, between the prongs of which there is articulated at 40 the end of the piston rod of a fluid dynamic cylinder 41 designed to actuate the shaft 36 with an oscillating movement and consequently to move the idler roller towards and away from the periphery of the wheel 11 for the reasons to be illustrated below.

The movement of the shafts 12, 20 and 23 is provided by a gear unit 42 on whose output shaft 43 there is keyed a toothed wheel 44 for a chain on which there is wound a chain 45 which also winds about a toothed wheel 46 for a chain keyed on the shaft 23, an idler return chain wheel 47, a chain wheel 48 keyed on the shaft 12 which returns to the chain wheel 44 keyed on the output shaft 43 of the gear unit 42.

A cam 49 operating on the arm 20a of the shaft 20 is keyed on the output shaft 43 of the gear unit 42 between the chain wheel 44 and the body of the reduction gear of the gear unit 42.

A sector of the wheel 11 is also provided with take-up holes 11d (see FIG. 3) operating by suction and communicating in a known manner with a suction source (not shown).

Figure 4:
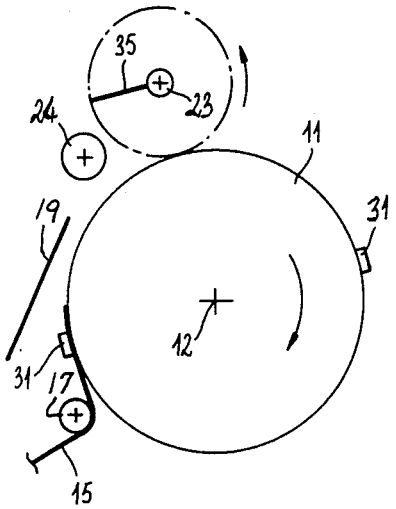
FIGS. 4, 5, 6 and 7 show four operative stages of the apparatus in question in diagrammatic form.
Figure 5:
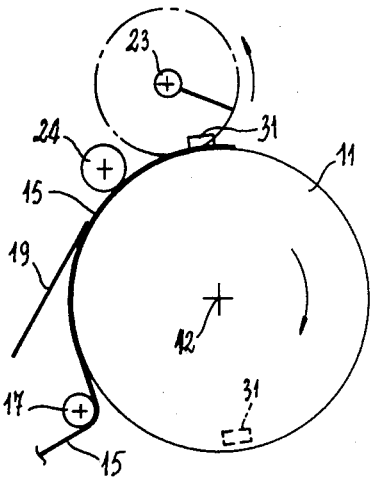
Figure 6:
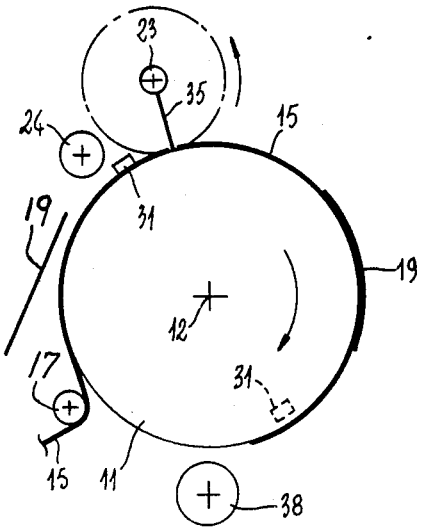
Figure 7:
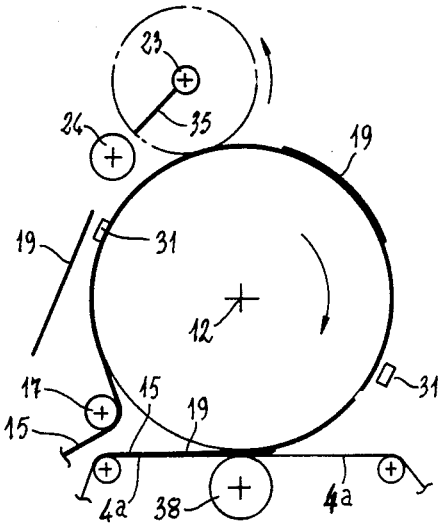

The operation of the apparatus described by way of example above is substantially as follows:

The adhesive tape 15 caused to pass over the return rollers 17 is brought into contact with the peripheral surface of the wheel 11 where, by means of moving apparatus, it is held by suction across the holes 11d and by the gripper component 31, with the adhesive surface facing outwardly, and caused to move (see FIG. 4). At this point, by means of the cam 49 acting on the arm 20a (see FIG. 2) the shaft 20 and therefore the container 18 are caused to oscillate so as to supply a strip 19 to the adhesive portion of the tape 15 (see FIG. 5). As a result of the counter-rotating movement of the wheel 11 and the knife 35, the tape 15 is cut so as to provide a section of tape 15a with a strip 19 applied by adhesion thereto in an intermediate position, leaving end sections of the tape with the adhesive exposed (see FIG. 6). At this point the rotation of the wheel 11 continues and the shaft 36 is caused to oscillate by the fluid dynamic cylinder 41 and consequently the idler roller 38 is detached from the periphery of the wheel 11 so as to enable the gripper component 31 to pass (see FIG. 6). Following this and after the passage of the gripper 31, the idler roller 38 is brought towards the periphery of the wheel 1 so as to apply by adhesion the tape section 15a to the strip of heat-shrinkable material 4a by means of its adhesion end sections left exposed by the strip 19 (see FIG. 7) so as to enable the tape section 15a, once the article 7 has been wrapped, to be readily picked up by means of the strip 19 formed as a handle *7a* (see FIG. 1) for the handling of this article 7.

The description of the apparatus in question made with reference to the attached drawings is obviously given only by way of example and it is therefore evident that any modifications or variations suggested by practice and by its implementation and use may be made thereto provided that they do not depart from the scope of the following claims.

I claim:

1. An apparatus for wrapping an article, comprising:

means defining a transport path for a succession of articles to be wrapped;

supply means along said path for feeding a web of heat-shrinkable material into contact with each of said articles at a wrapping station for wrapping said articles with said web so that said web upon wrapping around said article forms an outer surface of a wrapping on each article;

a wheel assembly at said station adjacent to and above said path and tangential to a side of said web forming said outer surface for applying handle lengths to said web so that each length forms a handle for a respective wrapped article;

means for feeding a continuous strip of an adhesive tape to a periphery of said wheel assembly;

means on said wheel assembly for retaining said strip of adhesive tape adjacent said periphery with an adhesive side of said strip of adhesive tape turned outwardly;

means adjacent said wheel assembly for applying to said adhesive side of said strip of adhesive tape on said periphery a masking strip covering said adhesive side at a location spaced from a free end of said strip of adhesive tape so as to form a handle portion on said strip;

means adjacent said wheel assembly for cutting said strip of adhesive tape on said periphery at a location spaced from said handle portion so as to cover a respective handle length from said strip of adhesive tape so that the severed length has adhesive regions on opposite ends thereof and to form a new free end of said continuous strip of adhesive tape on said periphery of said wheel assembly;

means for pressing said web against said wheel assembly so as to bond said adhesive regions to said side of said web and thereby affix each handle length thereto; and a tunnel furnace along said path downstream of said wheel assembly for shrinking the web wrapping each article therearound.

2. The apparatus for wrapping an article defined in claim 1 wherein said wheel assembly comprises:

a drum rotatable about a horizontal axis defined by an inner wheel and a pair of outer wheels flanking said inner wheel and confining said adhesive tape to the periphery of said inner wheel;

a pressing roller urged toward the periphery of said inner wheel and pressing said adhesive tape against said periphery of said inner wheel, and cam means cooperating with said roller for controlling the pressing of said adhesive tape thereby.

3. The apparatus for wrapping an article defined in claim 2 wherein said means for cutting includes:

a cutting shaft parallel to said horizontal axis;

a knife radially mounted on said shaft and rotatable thereby into cutting engagement with said adhesive tape on the periphery of said inner wheel; and drive means operatively connecting said shaft and said wheel assembly for counterrotation of said knife and said drum.

4. The apparatus for wrapping an article defined in claim 2 wherein said wheel assembly further comprises:

a gripper mounted on said drum and having a finger adapted to reach over an edge of said drum and to engage said adhesive tape;

means for mounting said gripper to pivot about a gripper axis perpendicular to said horizontal axis; and a spring engaging said gripper for urging said finger into engagement with said adhesive tape.

5. The apparatus for wrapping an article defined in claim 4 wherein said means for supplying said strip of adhesive tape includes:

a holder pivotable about a holder axis parallel to said horizontal axis and provided with means for mounting a plurality of tape spools at angularly spaced locations on said holder about said holder axis;

guide means for drawing said strip of adhesive tape from said spools and feeding said strip to said periphery of said inner roller; and an automatic device along said guide means for joining an end portion from one of said spools of a strip of said adhesive tape to an initial portion of said adhesive tape from another of said spools.

6. The apparatus defined in claim 4 wherein said means for applying said masking strip includes:

a container shaft parallel to said horizontal axis, provided with an arm on an end of said shaft, a cam acting on said arm for oscillating said shaft; and a parallelopipedic container receiving a stack of said masking strips mounted on said shaft for supplying said masking strips to said strips of adhesive tape.

7. The apparatus defined in claim 6 wherein said means for pressing said web includes:

another shaft parallel to said container shaft;

a pressing roller acting on the periphery of said drum and mounted on said other shaft; and a fluid dynamic cylinder connected to said other shaft for displacing said pressing roller to apply said strip of adhesive tape with said masking strip to said web of heat-shrinkable material while allowing said gripper to pass.

* * * * *